US005769683A

United States Patent [19]

Park

[11] Patent Number: 5,769,683

[45] Date of Patent: Jun. 23, 1998

[54] ATTACHMENT FOR BALLOON TETHER

[76] Inventor: Young-ho Park, 1639 Holly Ave., Northbrook, Ill. 60062

[21] Appl. No.: 798,434

[22] Filed: Feb. 10, 1997

[51] Int. Cl.[6] ..... A63H 3/06

[52] U.S. Cl. ..... 446/220; 24/304; 24/DIG. 11

[58] Field of Search ..... 446/222, 224, 446/220; 24/30.5 R, 304, DIG. 11

[56] References Cited

U.S. PATENT DOCUMENTS

| | | | |
|---|---|---|---|
| 3,783,551 | 1/1974 | Allison et al. | 46/90 |
| 3,900,989 | 8/1975 | Weisenthal | 46/88 |
| 4,077,588 | 3/1978 | Hurst | 244/31 |
| 4,391,063 | 7/1983 | Gill, III | 46/90 |
| 4,516,949 | 5/1985 | Schwartz | 446/222 |
| 4,560,360 | 12/1985 | Isaacs et al. | 446/222 |
| 4,916,560 | 4/1990 | Herrington | 24/30.5 R X |
| 4,917,646 | 4/1990 | Kieves | 446/224 |
| 4,993,664 | 2/1991 | Kneeland | 244/94 |
| 5,282,914 | 2/1994 | Spendlove | 24/304 X |
| 5,514,022 | 5/1996 | Harris | 446/75 |
| 5,547,413 | 8/1996 | Murray | 446/222 X |
| 5,595,521 | 1/1997 | Becker | 446/224 |

*Primary Examiner*—James R. Brittain
*Attorney, Agent, or Firm*—Robert A. Yesukevich

[57] ABSTRACT

A method of attaching a tether to a balloon is described. The method comprises pinching or flexing a metalized sheet balloon attached to one or more adhesive layers, or one more double-sided adhesive strips. The flexing causes outward-facing pressure sensitive adhesive layers disposed on the balloon, or on the strips, to oppose each other in a pincers movement, so as to surround and grip the tether. The strips themselves are previously attached to the balloon by inward-facing adhesive layers through a simple slapping motion. The removable sheet is easily peeled away prior to the flexing. The invention is also a fastener for attaching a balloon to a tether, and a balloon system including the fastener.

19 Claims, 2 Drawing Sheets

ATTACHMENT FOR BALLOON TETHER

BACKGROUND OF THE INVENTION

1. Field of the Invention

The invention relates generally to methods and devices for attaching a tether to a balloon. More specifically, the invention relates to improvements in attaching a tether to a metalized sheet balloon.

2. Description of Related Art

Toy balloons are normally manufactured as component parts for shipment. The component parts are assembled by, for example, a retail merchant located relatively near to the place where the balloon is ultimately utilized. It is typically the retail merchant or a member of her staff who inflates the balloon, seals the balloon, and attaches means for tethering the balloon, such as a string, a ribbon, or a stick.

Inflatable toy balloons have traditionally been constructed of elastic materials, such as rubber. More recently, balloons made of metalized sheet materials, particularly metalized plastic sheet materials, have become popular. One example of a metalized sheet material is a polyethylene terephthalate-based material which is commercially available under the tradename Mylar. The metalized sheet balloons are relatively less susceptible to gas loss by diffusion through the body of the balloon, and are eminently suited for decoration by well known printing techniques. Metalized sheet balloons are described in U.S. Pat. No. 4,077,588 issued to Hurst, which is hereby incorporated in its entirety and especially for its teachings regarding Mylar balloons.

While the metalized sheet balloons are entirely satisfactory for many purposes, their popularity has placed a burden on merchants who are expected to attach the balloons to tether strings, tether ribbons, tether sticks, and the like. Unlike the earlier elastic balloons, metalized sheet balloons have necks which cannot be stretched or tied into knots to facilitate attachment of a tether. The alternative of wrapping a tether string around the neck of a metalized sheet balloon is not a complete solution, as the metalized sheet material is relatively smooth and slippery.

Perhaps in response to this problem, the metalized sheet balloons are often provided with a hole through which a string or ribbon may be threaded for tying. The threading and tying method of attachment is normally performed separately from and in addition to the process of inflating and sealing metalized sheet balloons. While the threading and tying method of attachment is widely practiced, the method is tedious and time-consuming.

Some retail merchants have attempted to solve the problem of string attachment themselves by, for example, holding a tether string against the neck of a metalized sheet balloon and placing a bit of one-sided adhesive tape over the string to secure it to the balloon. Although it is believed that such taped over balloons have been sold, this method of attachment is relatively weak and unsightly. Moreover, the process of placing tape over the string is ill-suited to rapid assembly of balloons in circumstances where many balloon sales opportunities necessarily arise such as, for example, in the outdoors or in the midst of a crowd of people.

U.S. Pat. No. 4,560,360 issued to Isaacs et al. describes an inflatable assembly with edge closure formed of two superimposed sheets sealed at their peripheries to form a gas receiving compartment including opposing sheet portions. The sheet portions reportedly form an opening for receiving a gas conduit during inflation. Adhesive or a double-sided adhesive strip is reportedly provided on one of the sheet portions facing the other sheet portion. The '360 patent states that premature adhesion between the sheet portions is prevented by a removable protective strip disposed between the adhesive surface and the facing sheet portion. After inflation of the assembly and removal of the strip, application of pressure to the sheet portions reportedly seals the opening to prevent escape of gas. A tether string is apparently threaded through a hole in the double-sided adhesive strip and tied in a knot in the traditional manner to effect attachment.

U.S. Pat. No. 4,993,664 issued to Kneeland describes an equilibrium ballast apparatus for lighter-than-air balloons. The described ballast apparatus is secured to the interior or exterior surface of the neck of the balloon using a double-faced adhesive tape. The ballast apparatus reportedly includes a body formed from a top shell member and a bottom shell member which are bonded together. The '664 patent states that the bottom shell member includes an enlarged blade section which defines a tether opening sufficiently large in diameter that a cord or ribbon may be threaded through. Apparently, a knot is tied to secure the cord or ribbon in the traditional manner.

U.S. Pat. No. 4,391,063 issued to Gil, III describes a sealing device for a balloon comprising a thin deformable strip of foil attached to a flexible balloon retainer line. The foil strip is reportedly of a thickness that may be readily wound about the neck of the inflated balloon to prevent the escape of gas through the balloon neck portion, while at the same time attaching the retainer string to the balloon. In order to simultaneously form the sealing device and attach the line to the sealing device, the foil strip is reportedly coated on one side with pressure sensitive adhesive, one end of the line is laid lengthwise on the adhesive, and the foil strip is folded. The adhesive is said to secure the folded over wall sections to one another as well as securing and clasping the retainer line therebetween. The '063 patent states that upon twisting or wrapping the foil section of the sealing device about the neck of the balloon, the retainer is automatically coupled to the balloon. While the twisting or wrapping method of the '063 patent may offer some advantage over the traditional threading and tying method, a method for attaching a tether which requires less manipulation of the balloon and tether is desirable.

U.S. Pat. No. 5,514,022 issued to Harris describes a balloon package for facilitating the erection of a balloon assembly which prevents unintentional loss of buoyant balloons. The buoyancy of the balloon is reportedly overcome by attaching a placard having sufficient mass. As one embodiment, the '022 patent describes a balloon package in which a ribbon with an adhesive coating is looped through an aperture in the neck of the balloon and doubled over to form a closed loop for securing the balloon to the placard. While the looped ribbon method described by the '022 patent may be more convenient than tying the ribbon in a knot, the method apparently requires threading. Moreover, the looped ribbon method does not appear to be readily adaptable for use with other means for tethering, such as strings or sticks.

Despite the significant efforts and advances recounted above, there still exists a need for an improved method of attaching a tether to a metalized sheet balloon. Preferably, the improved method produces a finished balloon which is attractive and firmly attached to the tether. More preferably, the improved method is performed relatively rapidly and reproducibly by one person without a workshop or special tools. Most preferably, the improved method avoids tedious manipulations of the balloon components which require concentration and fine motor coordination, such as threading or wrapping or tying.

SUMMARY OF THE INVENTION

The present invention is a method of attaching a tether to a balloon which comprises pinching or flexing a metalized sheet balloon attached to one or more adhesive layers or to one or more double-sided adhesive strips. The flexing causes outward-facing adhesive layers disposed on the balloon or on the strips to oppose each other in a pincers movement, so as to surround and grip the tether. The strips themselves are previously attached to the balloon by inward-facing adhesive layers through a simple slapping motion. The slapping motion is performed while the strips are mounted by their outward-facing adhesive layers on a removable sheet which, when two or more strips are utilized, maintains the relative separation of the strips. The removable sheet is easily peeled away prior to the flexing. The invention is also a fastener for attaching a balloon to a tether, and a balloon system including the fastener.

In one aspect, the invention is a fastener for attaching a tether string to a metalized sheet balloon. The fastener comprises a double-sided flexible adhesive strip including a balloon-facing side and an outward-facing side. Each of the sides support a layer of adhesive material The strip is attached by the adhesive layer supported by the balloon-facing side to an external surface defined by a flexible elongated neck of a metalized sheet balloon. The strip is attached to the neck at a position which permits the outward-facing adhesive layer to contact and adhere to a tether for the balloon. When the balloon neck is flexed, the position of the strip permits a portion of the adhesive layer supported by the outward-facing side to contact and adhere to another portion of the adhesive layer supported by the outward-facing side. Alternatively, the strip may be positioned to contact and adhere to the tether and the external surface of the balloon when flexed. The tether string, surrounded by and affixed to the contacting portions, is thereby attached to the balloon.

In another aspect, the invention is a fastener which comprises two double-sided adhesive strips, each of the strips including a balloon-facing side and an outward-facing side. Each of the sides supports a layer of adhesive material. Each of the strips is attached by the adhesive layer which is supported by its balloon-facing side to an external surface defined by a flexible elongated neck of a metalized sheet balloon. The strips are attached to the neck at positions which, when the balloon neck is flexed, permit the outward-facing adhesive layers to contact and adhere to a tether string for the balloon. The positions of the strips permit the adhesive layer supported by the outward-facing side of one of the strips to contact and adhere to the adhesive layer supported by the outward-facing side of the other of the strips, in order to attach the tether to the balloon.

In still another aspect, the invention is a method of attaching a tether to a balloon. The method comprises flexing an elongated neck of a metalized sheet balloon. The neck defines an external surface attached to two double-sided adhesive strips, each of the strips including a balloon-facing side and an outward-facing side. The sides each support a layer of adhesive material. The strips are attached to the external surface of the neck by the balloon-facing adhesive layers. Flexing the neck moves the outward-facing adhesive layers into opposition with each other. One of the outward-facing adhesive layers is affixed to a tether for the balloon. The adhesive layer supported by the outward-facing side of one of the strips is forced into contact with the adhesive layer supported by the outward-facing side of the other of the strips. As a result, the outward-facing adhesive layers grip each other and the tether and, thereby, attach the tether to the balloon.

In yet another aspect, the invention is a method of attaching a string to a balloon which comprises flexing an elongated neck of a metalized sheet balloon which defines an external surface and simultaneously flexing a flexible double-sided adhesive strip which is attached to the external surface of the neck. The strip includes a balloon-facing side and an outward-facing side, each of the sides supporting a layer of adhesive material. The strip is attached by the adhesive layer supported by the balloon-facing side of the respective strip to the external surface of the neck. The flexing of the neck and the strip moves two portions of the outward-facing adhesive layer into opposition with each other. The outward-facing adhesive layer is placed in contact with a tether for the balloon. One of the opposed adhesive layis attached to the balloon. The adhesive layers are flexed to grip the tether and each other or, alternatively, to grip the tether and an external surface of the balloon.

In an additional aspect, the invention is a balloon system including a fastener for attaching a tether to a balloon. The system which comprises a metalized sheet balloon including a neck which defines a flexible external surface, a tether, and a fastener as described above.

DESCRIPTION OF PREFERRED ASPECTS OF THE INVENTION

Figure 1:
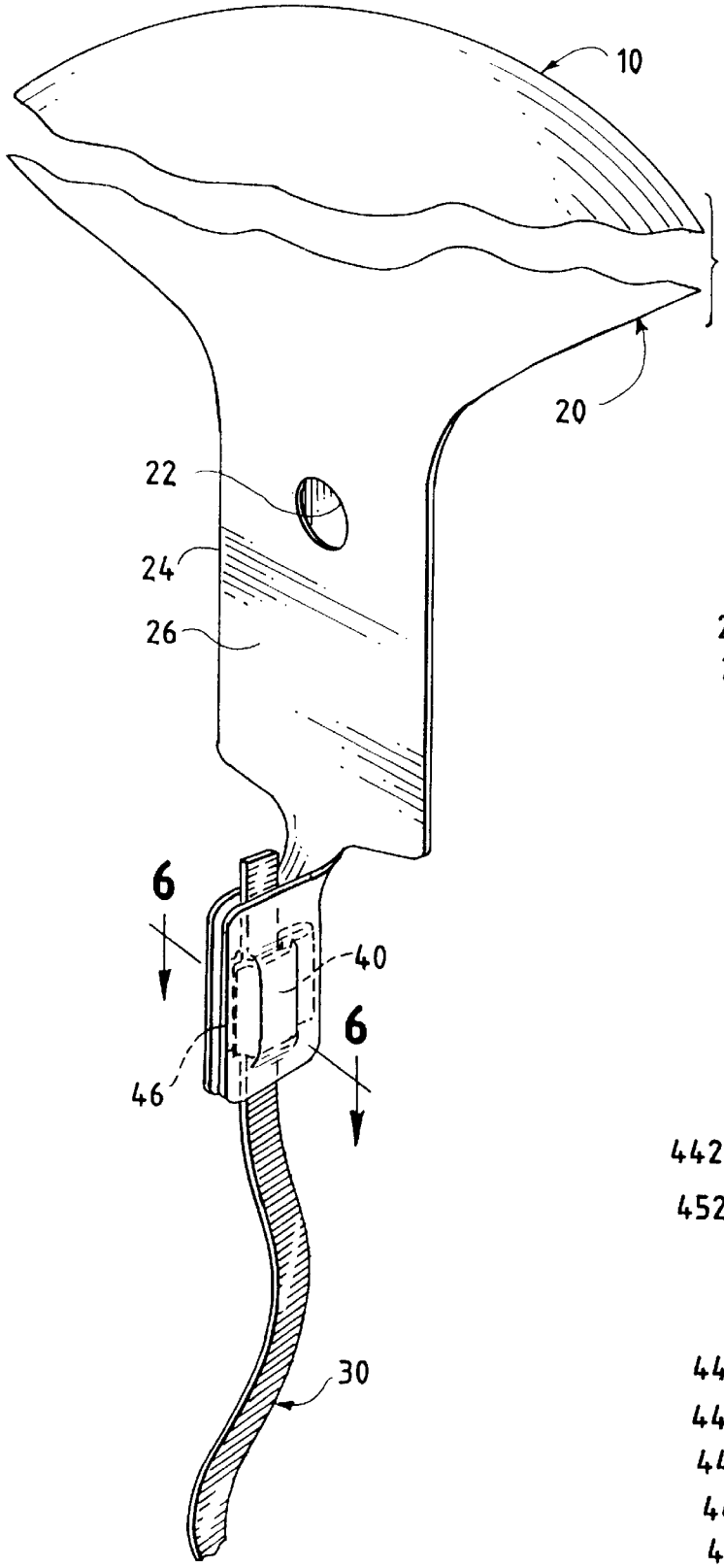
FIG. 1 is an isometric view of a balloon system including a metalized sheet balloon having an elongated neck, a tether, and a fastener including one double-sided adhesive strip for attaching the tether to the balloon.

In a preferred aspect, the invention is a balloon system 10 as depicted in FIG. 1. System 10 comprises a conventional metalized sheet balloon 20 including a flexible neck 24 which defines an external surface 26. For the present purposes, a metalized sheet balloon is an inflatable bag constructed of a thin, relatively inelastic sheet material coated by an electrically conducting metal compound. A valve inlet 22 for inflating the balloon 20 is located in neck 24.

A tether 30 serves as a handle and can be used to anchor the balloon 20. Although the tether 30 depicted in FIG. 1 is a ribbon, the tether may optionally be a string, a stick, a thread, or the like. The tether 30 is attached to the balloon 20 by an adhesive fastener 40 including a double-sided adhesive strip 46 which is affixed to the tether 30 and to the external surface 26 of the balloon.

Figure 2:
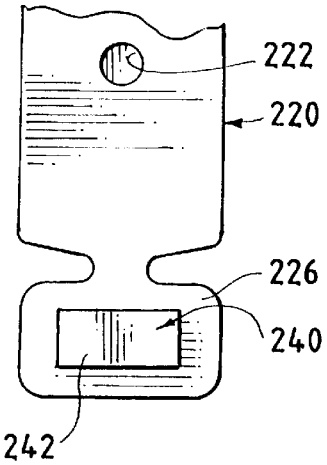
FIG. 2 is a partial elevation view of the balloon neck of FIG. 1, showing the neck and the fastener as they appear before a protective sheet is removed from the fastener and before the tether is affixed.

In the accompanying drawings, elements of one figure which correspond to elements depicted in another figure are designated by element numbers having the same last two digits. For example, the fastener 240 in FIG. 2 corresponds to the fastener 40 in FIG. 1. Similarly, the neck 224 of FIG. 2 corresponds to the neck 24 of FIG. 1. FIG. 2 shows a partial elevation view of neck 224 as it appears before a removable protective sheet 242 is removed and before a tether (not shown), is affixed.

Figure 3:
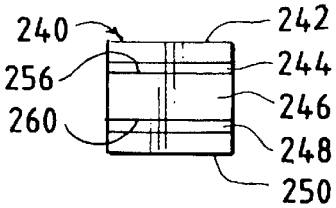
FIG. 3 is a plan view of the fastener including one double-sided adhesive strip as it appears with protective sheets in place on both the balloon-facing and outward-facing sides.

Referring now to FIG. 2, it can be seen that fastener 240 is relatively flat before it is affixed to a tether. The fastener 240 incudes components which are best seen in a plan view illustrated in FIG. 3 The fastener 240 comprises a double-sided flexible adhesive strip 246 including an outward-facing side 256 and a balloon-facing side 260. The outward-facing side 256 supports an adhesive layer 244, while the balloon-facing side 260 supports an adhesive layer 248. Each of the adhesive layers (244 and 248) is covered by a removable protective sheet (242 and 250, respectively) which is preferably kept in place until immediately before the respective adhesive layer is employed.

While the adhesive layer may be composed of any suitable adhesive material, it is preferred that the adhesive layer is composed of a pressure sensitive adhesive. It is especially preferred that the adhesive material adheres strongly to the balloon, to the tether, and to other adhesive layers, while the adhesive material adheres only weakly to the protective sheet. Such a difference in adhesion can be achieved by properly selecting materials for the adhesive and the protective sheet. The details of the selection process are well known.

To prepare the fastener 240 for use, the protective sheet 250 on the balloon-facing side 260 of the adhesive strip 246 is first removed. The balloon-facing side 260 is then affixed on the balloon 220 by pressing the balloon-facing side 260 against the external surface 226 of the balloon neck 224. This operation may be performed by the manufacturer as part of the balloon manufacturing process, by the retail merchant nearer the point of use, or even by the ultimate consumer. Significantly, the fastener may now be put aside until a rapid assembly of the balloon system is desired.

Assembly of the balloon system is completed by attaching the tether. The tether may be attached either before or after the balloon 220 is inflated. The protective strip 242 covering the outward-facing side 256 of the fastener 240 is now removed. The fastener 240 is flexed into a crescent shape, making the outward-facing side 256 concave. This can be accomplished using one hand while the tether is held in the other hand. This flexing causes portions of outward-facing adhesive layer 244 to oppose each other in a pincers movement so as to surround and grip the tether. Preferably, the flexing movement ends by forcing adhesive layer 244 in on itself and against the tether in order to strengthen the attachment and make it relatively permanent.

Figure 4:
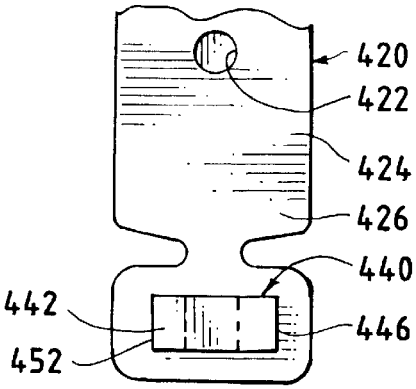
FIG. 4 is a partial elevation view of a balloon neck and a fastener including two double-sided adhesive strips, as they appear before a protective sheet is removed from the fastener and before a tether is affixed.
Figure 5:
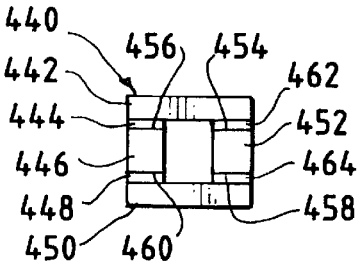
FIG. 5 is a plan view of the fastener including two double-sided strips as it appears with protective sheets in place on both the balloon-facing and outward-facing sides.

In another preferred aspect, the invention is a fastener for attaching a tether to a metalized sheet balloon as shown in FIG. 4. Turning now to FIG. 4 and FIG. 5, the fastener 440 includes two double-sided adhesive strips (452 and 446) which are positioned side-by-side with a space between the strips. The space between strips facilitates flexing of the balloon 420 in the area between the strips, thereby producing a more uniform attachment with less effort.

Preferably the strips (452 and 446) are disposed about the longitudinal axis of the balloon neck 424. In that case, a line connecting the strips is transverse to the longitudinal axis of the neck 424 when the balloon 420 is deflated. Preferably, each of the strips (452 and 446) has a shape which is a mirror image of the other of the strips. Preferably, each of the strips (452 and 446) has a length and a width which is essentially identical to the length and the width of the other of the strips.

Each of the strips (452 and 446) has a balloon-facing side (458 and 460, respectively) and an outward-facing side (454 and 456, respectively). Each of the sides supports a layer of adhesive material (464, 448, 444, and 462, respectively). FIG. 5 shows the fastener 440 with both removable protective sheets (450 and 442) in place. FIG. 4 shows the fastener 440 as it appears attached to the external surface 426 of the balloon, after the balloon-facing protective sheet 450 has been removed.

The method for operating the fastener 440 having two flexible, double-sided adhesive strips (452 and 446) is substantially similar to the method described above with regard to the fastener 240 which has a single double-sided adhesive strip 246, except that flexing the neck 424 moves the outward-facing adhesive layers (444 and 462) into opposition so that the outward-facing adhesive layers (444 and 462) grip each other and the tether.

Figure 6:
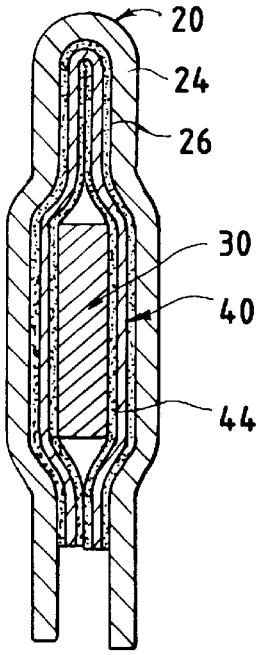
FIG. 6 is a cross-sectional view, looking downward from section line A—A of FIG. 1, of the balloon system with the one strip fastener secured and the tether attached.

FIG. 6 is a cross-sectional view of the balloon system 10, as it appears to a viewer looking downward from section line A—A of FIG.1. FIG. 6 shows the fastener 40 after the neck 24 and the double-sided strip 46 have been flexed. Opposed portions of the outward-facing adhesive layer 44 contact and grip each other and adhere to the tether 30. By virtue of being trapped between and affixed to opposed portions of the outward-facing adhesive layer 44, the tether 30 is securely attached to the balloon 20.

Figure 7:
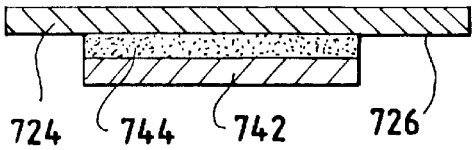
FIG. 7 cross-sectional view of a balloon neck attached to a fastener of the present invention including an adhesive layer and a protective covering sheet.
Figure 8:
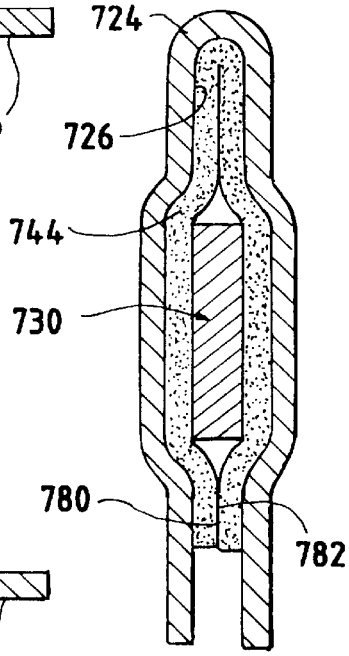
FIG. 8 is a cross-sectional view of the balloon neck and the fastener depicted in FIG. 7 as they appear after the protective covering sheet is removed and a tether is attached.

In yet another preferred aspect, a flexible adhesive layer 744 is applied directly to an external surface 726 of a balloon neck 724, as shown in cross-sectional FIG. 7. The adhesive layer 744 amy be applied, for example, at the point of balloon manufacture as one step in a mechanized production line. Preferably, a protective covering sheet 742 is placed over the outward-facing side of the adhesive layer 744. The covering sheet 742 is removed before a tether 730 is attached. FIG. 8 depicts the balloon neck 724 in cross-section as it appears after flexing and attachment of the tether 730. Opposable portions (780 and 782) of the outward-facing side of the adhesive layer grip the tether and each other so as to attach the tether to the balloon neck 724.

Figure 9:
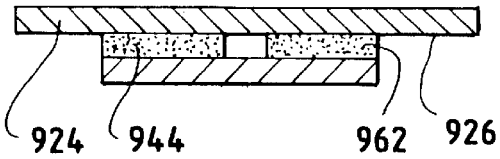
FIG. 9 ts a cross-sectional view of a balloon neck attached to a fastener of the present invention including two discrete adhesive layers and a protective covering sheet.
Figure 10:
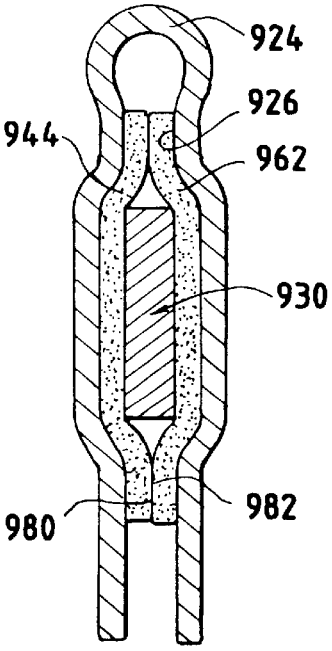
FIG. 10 is a cross-sectional view of the balloon neck and the fastener shown in FIG. 9 as they appear after the protective covering sheet is removed and a tether is attached.

In still another preferred aspect, the invention includes two or more discrete adhesive layers, such as adhesive layers 944 and 962 which can be seen in cross-sectional FIG. 9. Referring now to FIG. 10, outward-facing sides (980 and 982) of adhesive layers (944 and 962, respectively) are brought into opposition by flexing a balloon neck 924 to which the layers are attached. FIG. 10 illustrates in cross-section the balloon neck 924 and adhesive layers (944 and 962) after flexing and attachment of a tether 930, at which time the outward-facing sides (980 and 982) grip each other and the tether 930.

Figure 11:
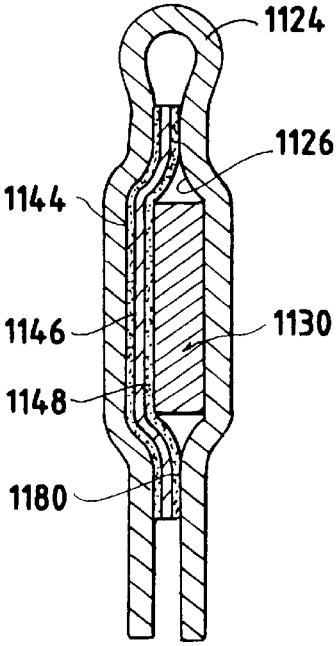
FIG. 11 is a cross-sectional view of a balloon neck attached to a tether by a fastener of the present invention which includes a double-sided adhesive strip.
Figure 12:
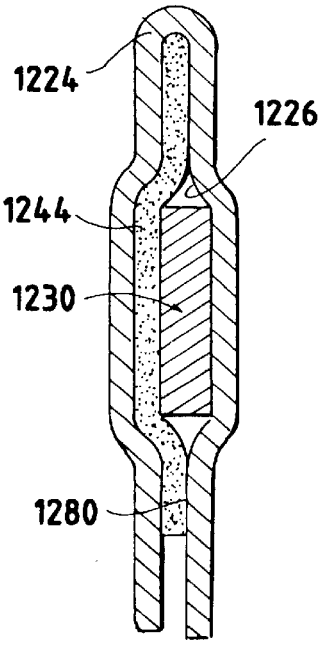
FIG. 12 is a cross-sectional view of a balloon neck attached to a tether by a fastener of the present invention which includes an adhesive layer.

FIG. 11 is a cross-section of a preferred aspect of the invention in which balloon neck 1124 attached to a tether 930. It can be seen that outward-facing side 1180 is in contact and affixed to the tether 930 and an external surface 1126 of the balloon neck 1124. Cross-sectional FIG. 12 shows an adhesive layer 1244 having an outward-facing side 1280 which grips a tether 1230 and an external surface 1226 of balloon neck 1224.

Although several aspects of the invention have been described in detail above, practitioners who study the disclosure will understand that other aspects of the invention certainly exist. The description of certain preferred aspects is intended to communicate and not to limit the invention. The scope of the invention is defined by the appended claims.

I claim as my invention:

1. A balloon system which includes a metalized sheet balloon, a tether, and a fastener for attaching the tether to the balloon, the system comprising:

a metalized sheet metal balloon which includes a flexible elongated neck, the neck defining an external surface;

a double-sided flexible adhesive strip which includes a balloon facing side and an outward-facing side, each of the sides supporting a layer of adhesive material, wherein the strip is attached by the adhesive layer supported by the balloon-facing side to the external surface defined by the neck, wherein the neck and the strip are flexed so as to define and bring into contact two opposed portions of the outward-facing adhesive layer, and wherein each of the opposed portions adheres to the other of the opposed portions; and a tether disposed between the opposed portions, the tether in contact with and affixed to each of the opposed portions, thereby attaching the tether to the balloon.

2. The balloon system of claim 1 in which the adhesive layer supported by the outward-facing side of the strip is covered by a removable protective sheet before the tether is attached to the balloon.

3. The balloon system of claim 1 in which the adhesive layers are composed essentially of a pressure sensitive adhesive material.

4. A balloon system which includes a metalized sheet balloon, a tether, and a fastener for attaching the tether to the balloon, the system comprising:

a metalized sheet metal balloon which includes a flexible elongated neck, the neck defining an external surface;

two double-sided adhesive strips, each of the strips including a balloon facing side and an outward-facing side, and each of the sides supporting a layer of adhesive material;

wherein each of the strips is attached by the adhesive layer supported by the balloon-facing side of the respective strip to the external surface defined by the neck, wherein the neck is flexed so as to bring into contact adhesive layers supported by the outward-facing sides, and wherein each of the adhesive layers supported by the outward-facing sides adheres to the other of the adhesive layers supported by the outward-facing sides; and a tether disposed between the adhesive layers supported by the outward-facing sides, the tether in contact with and affixed to each of the adhesive layers supported by the outward-facing sides, thereby attaching the tether to the balloon.

5. The balloon system of claim 4 in which the adhesive layers supported by the outward-facing sides of the strips are covered by a removable protective sheet.

6. The balloon system of claim 4 in which the strips are disposed about the longitudinal axis of the balloon neck, each of the strips has a shape which is a mirror image of the shape of the other of the strips, and each of the strips has a length and a width which are essentially identical to the length and the width of the other of the strips.

7. The balloon system of claim 4 in which the adhesive layers are essentially composed of a pressure sensitive adhesive material.

8. A balloon system which includes a metalized sheet balloon, a tether, and a fastener for attaching the tether to the balloon, the system comprising:

a metalized sheet metal balloon which includes a flexible elongated neck, the neck defining an external surface;

a flexible adhesive layer which includes a balloon facing side and an outward-facing side, the outward-facing side including two opposable portions which can be moved into opposition by flexing the adhesive layer, and the balloon-facing side being attached by the adhesive layer to the external surface defined by the neck, wherein the neck and the adhesive layer are flexed so as to bring into contact the opposable portions, and wherein each of the opposable portions adheres to the other of the opposable portions; and a tether disposed between the opposable portions, the tether in contact with and affixed to each of the opposable portions, thereby attaching the tether to the balloon.

9. The balloon system of claim 8 in which the outward-facing side of the adhesive layer is covered by a removable protective sheet before the tether is attached to the balloon.

10. The balloon system of claim 8 in which the adhesive layer is composed essentially of a pressure sensitive adhesive material.

11. A balloon system which includes a metalized sheet balloon, a tether, and a fastener for attaching the tether to the balloon, the system comprising:

a metalized sheet metal balloon which includes a flexible elongated neck, the neck defining an external surface;

two discrete adhesive layers, each of the layers including a balloon facing side and an outward-facing side, each of the balloon-facing sides being attached to the external surface defined by the neck, wherein the neck is flexed so as to bring into contact each of the adhesive layers supported by the outward-facing sides, and wherein each of the adhesive layers supported by the outward-facing sides adheres to the other of the adhesive layers supported by the outward-facing sides; and a tether disposed between the adhesive layers supported by the outward-facing sides, the tether in contact with and affixed to each of the adhesive layers supported by the outward-facing sides, thereby attaching the tether to the balloon.

12. The balloon system of claim 11 in which the outward-facing sides of the adhesive layers are covered by a removable protective sheet before the tether is attached to the balloon.

13. The balloon system of claim 11 in which the adhesive layers are disposed about the longitudinal axis of the balloon neck, each of the strips has a shape which is a mirror image of the shape of the other of the strips, and each of the strips has a length and a width which are essentially identical to the length and the width of the other of the strips.

14. The balloon system of claim 11 in which the adhesive layers are composed essentially of a pressure-sensitive material.

15. A balloon system which includes a metalized sheet balloon, a tether, and a fastener for attaching the tether to the balloon, the system comprising:

a metalized sheet metal balloon which includes a flexible elongated neck, the neck defining an external surface;

a double-sided adhesive strip which includes a balloon facing side and an outward-facing side, each of the sides supporting a layer of adhesive material, wherein the strip is attached by the adhesive layer supported by the balloon-facing side to the external surface defined by the neck, wherein the neck is flexed so as to bring a portion of the external surface into opposition and contact with the adhesive layer supported by the outward-facing side, and wherein the portion of the external surface adheres to the adhesive layer supported by the outward-facing side; and a tether disposed between the portion of the external surface and the adhesive layer supported by the outward-facing side, the tether being in contact with the portion of the external surface and the adhesive layer supported by the outward-facing side, and the tether being affixed to the adhesive layer supported by the outward-facing side, thereby attaching the tether to the balloon.

16. The balloon system of claim 15 in which the adhesive layers are composed essentially of a pressure sensitive adhesive material.

17. A balloon system which includes a metalized sheet balloon, a tether, and a fastener for attaching the tether to the balloon, the system comprising:

a metalized sheet metal balloon which includes a flexible elongated neck, the neck defining an external surface;

an adhesive layer which includes a balloon facing side and an outward-facing side, wherein the balloon-facing side is attached to the external surface defined by the neck, wherein the neck is flexed so as to bring a portion of the external surface into opposition and contact with the outward-facing side, and wherein the portion of the external surface adheres to the outward-facing side; and a tether disposed between the portion of the external surface and the outward-facing side, the tether being in contact with the portion of the external surface and the outward-facing side, and the tether being affixed to the outward-facing side, thereby attaching the tether to the balloon.

18. The balloon system of claim 17 in which the outward-facing side of the adhesive layer is covered by a removable protective sheet before the tether is attached to the balloon.

19. The balloon system of claim 17 in which the adhesive layer is composed essentially of a pressure sensitive adhesive material.

* * * * *